US011959349B2

(12) United States Patent
Oberlin et al.

(10) Patent No.: US 11,959,349 B2
(45) Date of Patent: Apr. 16, 2024

(54) DOWNHOLE PRESSURE PULSE SYSTEM

(71) Applicant: National Oilwell Varco L.P., Houston, TX (US)

(72) Inventors: Paul Victor Oberlin, Houston, TX (US); John Matthew King, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 49 days.

(21) Appl. No.: 17/790,898

(22) PCT Filed: Jan. 5, 2021

(86) PCT No.: PCT/US2021/012186
§ 371 (c)(1),
(2) Date: Jul. 5, 2022

(87) PCT Pub. No.: WO2021/141899
PCT Pub. Date: Jul. 15, 2021

(65) Prior Publication Data

US 2023/0027048 A1 Jan. 26, 2023

Related U.S. Application Data

(60) Provisional application No. 62/957,771, filed on Jan. 6, 2020.

(51) Int. Cl.
*E21B 31/00* (2006.01)

(52) U.S. Cl.
CPC ..... *E21B 31/005* (2013.01)

(58) Field of Classification Search
CPC ..... E21B 31/005
See application file for complete search history.

(56) References Cited

U.S. PATENT DOCUMENTS

| | | | |
|---|---|---|---|
| 2014/0119974 A1 | 5/2014 | Kitching | |
| 2014/0190749 A1 | 7/2014 | Lorenson et al. | |
| 2014/0246240 A1 | 9/2014 | Lorenson et al. | |
| 2015/0075867 A1 | 3/2015 | Eddison et al. | |
| 2016/0281449 A1* | 9/2016 | Lorenson | E21B 21/10 |
| 2018/0291733 A1 | 10/2018 | Ritchie et al. | |

(Continued)

OTHER PUBLICATIONS

International Search Report and Written Opinion dated Mar. 23, 2021, for Application No. PCT/US2021/.

(Continued)

*Primary Examiner* — Giovanna Wright
(74) *Attorney, Agent, or Firm* — Conley Rose, P.C.

(57) ABSTRACT

A pressure pulse system includes a stator, a rotor rotatably positioned in the stator, and a valve assembly configured to induce a pressure pulse in response to rotation of the rotor within the stator, wherein the valve assembly includes a first valve plate coupled to one of the stator and the rotor and including a flow passage, and a second valve plate coupled to the other of the stator or the rotor to which the first valve plate is not coupled and comprising a first flow passage and a second flow passage that is spaced from the first flow passage, wherein the valve assembly provides a first flowpath and a second flowpath between the flow passage of the first valve plate and the second flow passage of the second valve plate.

19 Claims, 8 Drawing Sheets

(56) References Cited

U.S. PATENT DOCUMENTS

| | | | |
|---|---|---|---|
| 2019/0024459 | A1 | 1/2019 | Sicilian et al. |
| 2019/0153797 | A1* | 5/2019 | von Gynz-Rekowski ..... E21B 28/00 |

OTHER PUBLICATIONS

Extended European Search Report dated Dec. 13, 2023, for Application No. EP21738781.0.

* cited by examiner

DOWNHOLE PRESSURE PULSE SYSTEM

CROSS-REFERENCE TO RELATED APPLICATIONS

This application is a 35 U.S.C. § 371 national stage application of PCT/US2021/012186 filed Jan. 5, 2021, and entitled "Downhold Pressure Pulse System" which claims benefit of U.S. provisional patent application Ser. No. 62/957,771 filed Jan. 6, 2020, and entitled "Fixed Choke Agitator Valve," both of which are hereby incorporated herein by reference in their entirety for all purposes.

STATEMENT REGARDING FEDERALLY SPONSORED RESEARCH OR DEVELOPMENT

Not applicable.

BACKGROUND

In some well systems a tool string may be lowered through a wellbore that extends through a subterranean earthen formation. The tool string may encounter friction as the tool string is lowered through the wellbore in response to contact between an outer surface of the tool string and a wall of the wellbore. For example, coiled tubing drilling systems may include a tool string including a bottom hole assembly (BHA) attached to coiled tubing which slides through a wellbore as a drill bit of the BHA drills into the earthen formation in which the wellbore is formed. Friction between the tool string and the wall of the wellbore may reduce a maximum reach of the tool string through the wellbore as friction between the tool string and the wall of the wellbore as the tool string is lowered through the wellbore may eventually overwhelm the capabilities of a surface system responsible for injecting the tool string into the wellbore.

SUMMARY

An embodiment of a pressure pulse system disposable in a wellbore comprises a stator comprising a plurality of helical stator lobes, a rotor rotatably positioned in the stator and comprising a plurality of helical rotor lobes, and a valve assembly coupled to the stator and to the rotor and configured to induce a pressure pulse in response to rotation of the rotor within the stator, wherein the valve assembly comprises a first valve plate coupled to one of the stator and the rotor and comprising a flow passage, and a second valve plate coupled to the other of the stator or the rotor to which the first valve plate is not coupled and comprising a first flow passage and a second flow passage that is spaced from the first flow passage of the second valve plate, wherein the valve assembly comprises a first configuration that provides a first flowpath between the flow passage of the first valve plate and the second flow passage of the second valve plate, wherein the valve assembly comprises a second configuration that provides a second flowpath between the flow passage of the first valve plate and the first flow passage of the second valve plate. In some embodiments, the second flow passage of the second valve plate is circumferentially spaced about a central axis of the second valve plate from the first flow passage of the second valve plate. In some embodiments, the first valve plate is coupled to the rotor and a central axis of the first valve plate is coaxial with a central axis of the rotor, and the second valve plate is coupled to the stator and the central axis of the second valve plate is coaxial with a central axis of the stator, wherein the central axis of the second valve plate is offset from the central axis of the first valve plate. In certain embodiments, the first valve plate rotates about the central axis of the first valve plate in a first rotational direction and about the central axis of the second valve plate in a second rotational direction opposite the first rotational direction. In certain embodiments, a minimum flow area of the second flow passage of the second valve plate is less than both a minimum flow area of the first flow passage of the second valve plate and a minimum flow area of the flow passage of the first valve plate. In some embodiments, the first flowpath has a minimum flow area that corresponds to a minimum flow area providable through the valve assembly, and wherein the second flow passage of the second valve plate is encompassed entirely within the flow passage of the first valve plate in an end view when the valve assembly is in the first configuration. In some embodiments, the minimum flow area of the first flowpath corresponds to a minimum flow area providable through the valve assembly, and wherein a minimum flow area of the second flow passage of the second valve plate defines the minimum flow area of the first flowpath.

An embodiment of a pressure pulse system disposable in a wellbore comprises a stator comprising a plurality of helical stator lobes, a rotor rotatably positioned in the stator and comprising a plurality of helical rotor lobes, and a valve assembly coupled to the stator and to the rotor and configured to induce a pressure pulse in response to rotation of the rotor within the stator, wherein the valve assembly comprises a first valve plate coupled to one of the stator and the rotor and comprising a flow passage, and a second valve plate coupled to the other of the stator or the rotor to which the first valve plate is not coupled and comprising a flow passage, wherein the valve assembly comprises a first configuration that provides a first flowpath through the valve assembly between the flow passage of the first valve plate and the flow passage of the second valve plate, the first flowpath having a minimum flow area that corresponds to a minimum flow area providable through the valve assembly, and wherein the flow passage of the second valve plate is encompassed entirely within the flow passage of the first valve plate in an end view when the valve assembly is in the first configuration. In some embodiments, a minimum flow area of the flow passage of the second valve plate is less than a minimum flow area of the flow passage of the first valve plate. In some embodiments, the second valve plate comprises a first flow passage and a second flow passage that is spaced from the first flow passage, the second flow passage corresponding to the flow passage that is encompassed entirely within the flow passage of the first valve plate in an end view when the valve assembly is in the first configuration. In certain embodiments, the first valve plate is coupled to the rotor and a central axis of the first valve plate is coaxial with a central axis of the rotor, and the second valve plate is coupled to the stator and a central axis of the second valve plate is coaxial with a central axis of the stator, wherein the central axis of the second valve plate is offset from the central axis of the first valve plate. In certain embodiments, the first valve plate rotates about the central axis of the first valve plate in a first rotational direction and about the central axis of the second valve plate in a second rotational direction opposite the first rotational direction. In some embodiments, the valve assembly comprises a second configuration that provides a second flowpath between the flow passage of the first valve plate and the first flow passage of the second valve plate. In some embodiments, the second flowpath has a minimum flow area that corresponds to a maximum flow area providable through the valve assembly. In certain embodiments, a minimum flow area of the flow passage of the second valve plate defines the minimum flow area of the first flowpath.

An embodiment of a pressure pulse system disposable in a wellbore comprises a stator comprising a plurality of helical stator lobes, a rotor rotatably positioned in the stator and comprising a plurality of helical rotor lobes, and a valve assembly coupled to the stator and to the rotor and configured to induce a pressure pulse in response to rotation of the rotor within the stator, wherein the valve assembly comprises a first valve plate coupled to one of the stator and the rotor and comprising a flow passage, and a second valve plate coupled to the other of the stator or the rotor to which the first valve plate is not coupled and comprising a flow passage, wherein the valve assembly comprises a first configuration that provides a first flowpath through the valve assembly between the flow passage of the first valve plate and the flow passage of the second valve plate, wherein a minimum flow area of the first flowpath corresponding to a minimum flow area providable through the valve assembly, and wherein a minimum flow area of the flow passage of the second valve plate defines the minimum flow area of the first flowpath. In some embodiments, a minimum flow area of the flow passage of the second valve plate is less than a minimum flow area of the flow passage of the first valve plate. In some embodiments, the second valve plate comprises a first flow passage and a second flow passage that is spaced form the first flow passage, the second flow passage corresponding to the flow passage that defines the minimum flow area of the first flowpath. In certain embodiments, the valve assembly comprises a second configuration that provides a second flowpath between the flow passage of the first valve plate and the first flow passage of the second valve plate, the second flowpath having a minimum flow area that corresponds to a maximum flow area providable through the valve assembly. In certain embodiments, the flow passage of the second valve plate is encompassed entirely within the flow passage of the first valve plate in an end view when the valve assembly is in the first configuration.

BRIEF DESCRIPTION OF THE DRAWINGS

For a detailed description of exemplary embodiments of the disclosure, reference will now be made to the accompanying drawings in which.

DETAILED DESCRIPTION

Figure 1:
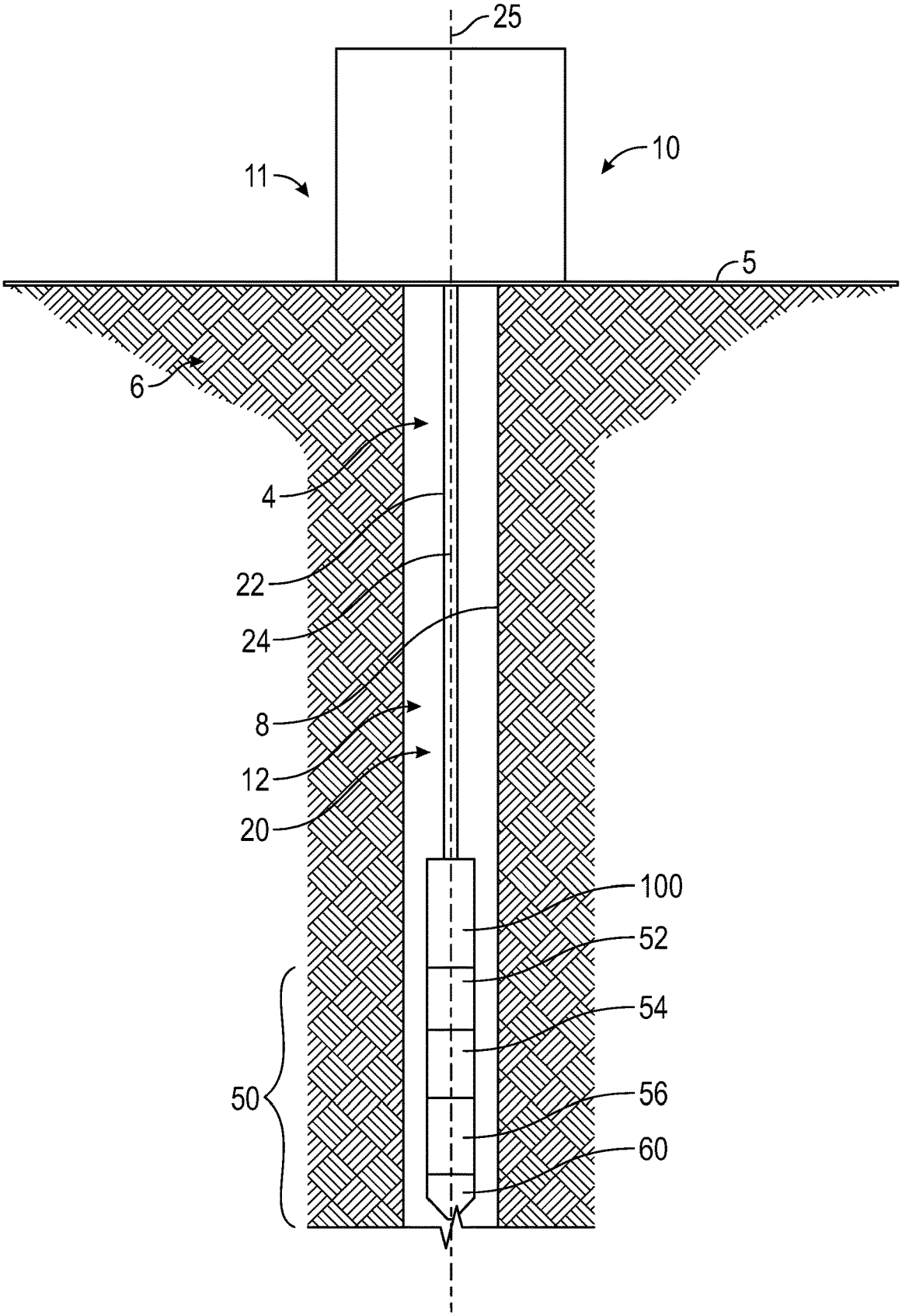
FIG. 1 is a schematic view of a well system according to some embodiments.
Figure 2:
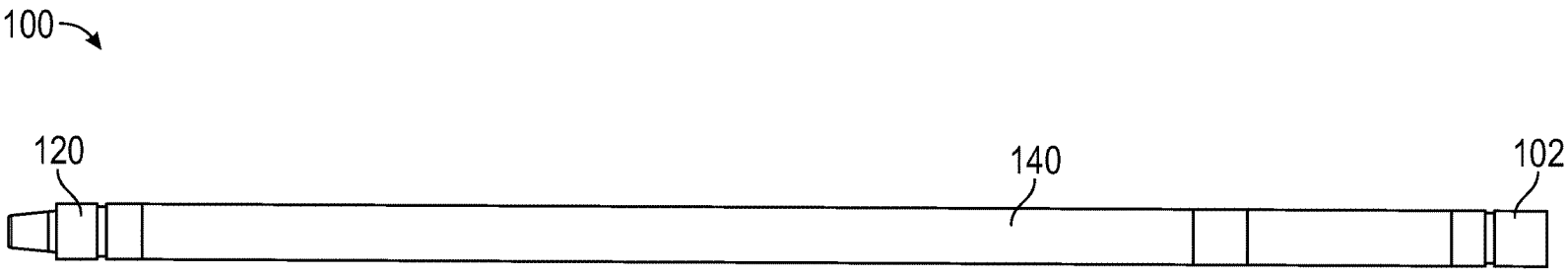
FIG. 2 is a side view of an agitator of the well system of FIG. 1 according to some embodiments.

The following discussion is directed to various exemplary embodiments.

However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

As described above, friction between a tool string and a wall of a wellbore as the tool string is conveyed through the wellbore may limit the maximum distance through which the tubing string may be extended through the wellbore. Additionally, friction between the tool string the wellbore wall may decrease the speed by which the tool string may be conveyed through the wellbore, thereby increasing the amount of time required to perform an operation in the wellbore (e.g., a drilling, completion, and/or production operation).

In some applications, the tool string may comprise an agitator configured to induce oscillating axial motion in the tool string to thereby reduce friction between the tool string and the wellbore wall by preventing the tool string from sticking or locking against the wellbore wall. The agitator may include a pair of valve plates each including a flow passage and which rotate relative to each other. The flow passages of the valve plates may enter into and out of various degrees of alignment as the valve plates rotate relative to each other such that a minimum flow area may be provided periodically through the agitator. The provision of the minimum flow area through the agitator may result in the generation of a pressure pulse in fluid flowing therethrough due to the obstruction in fluid flow resulting from the minimum flow area, the pressure pulse thereby inducing oscillating axial movement of the tool string. Thus, the magnitude of the pressure pulse induced by the agitator may be dependent on the size of the minimum flow area through the agitator. Indeed, in at least some applications, the magnitude of the pressure pulse may be sensitive to slight changes in the size of the minimum flow area.

The minimum flow area may correspond to a relative angular position between the pair of valve plates which produces a minimal amount of overlap between the flow passages of the valve plates. Thus, the minimum flow area provided by the agitator, and hence the magnitude of the pressure pulse, may be dependent on the size of the minimal amount of overlap that may be formed between the fluid passages of the pair of valve plates. In turn, the size of the minimal amount of overlap between the fluid passages may depend on the respective manufacturing tolerances of the valve plates, as well as the manufacturing tolerances of the components with which the valve plates are assembled to form the agitator. Given that the size of the minimal amount of overlap may be dependent upon the manufacturing tolerance of a plurality of components assembled or stacked together, the size of the minimal amount of overlap, and hence the magnitude of the pressure pulse, may vary substantially between similarly configured agitators (e.g., agitators comprising identically designed components). For example, each similarly configured agitator may comprise a housing to which one of the valve plates is coupled. The size of each housing may vary between two similarly configured agitators, resulting in a difference to the minimal amount of overlap between each agitator. This variability and lack of precision in the pressure pulse induced by each similarly configured agitator (resulting from the different manufacturing tolerance stack-ups of each agitator) may result in a pressure pulse that is either too weak to sufficiently reduce friction applied to the tool string or too strong whereby components of the tool string may become damaged due to the excessive oscillating axial motion induced by the overly great pressure pulse.

Accordingly, embodiments disclosed herein include agitators configured to induce a pressure pulse the magnitude of which is not dependent on the manufacturing tolerances of the respective components of which the agitator is comprised, thereby allowing for less variability and a greater level of precision with respect to the magnitude of the pressure pulse induced by the agitators disclosed herein. Particularly, embodiments disclosed herein include agitators comprising a first valve plate comprising a single flow passage and a second valve plate comprising a pair of flow passages with one of the pair of flow passages (e.g., a "minimum flow passage") defining a minimum flow area through the agitator. In other words, embodiments of agitators described herein do not rely on a minimal, partial overlap between flow passages to provide a minimum flow area, where the minimal overlap is influenced by the manufacturing tolerances of the components comprising the agitator. Instead, the flow passage which defines the minimum flow area of the agitator, being substantially smaller in cross-sectional area than the flow passage of the other valve plate, is encompassed entirely by the flow passage of the other valve plate. Given that the flow passage is encompassed entirely by the flow passage of the other valve plate, the manufacturing tolerances of the components comprising the agitator may not influence the minimum flow area through the agitator as the minimum flow passage always remains entirely encompassed by the flow passage of the other valve plate when the pair of valve plates are in a relative angular orientation forming the minimum flow area.

Referring now to FIG. 1, a well or drilling system 10 for drilling a wellbore 4 extending into a subterranean formation 6 is shown. Drilling system 10 includes a surface assembly 11 positioned at a surface 5 and a tool string 20 deployable into wellbore 4 from the surface 5 using a surface assembly 11 positioned at the surface 5 atop the wellbore 4. Surface assembly 11 may comprise any suitable surface equipment for forming wellbore 4 and may include, for example, a pump, a tubing reel, a tubing injector, and a pressure containment device (e.g., a blowout preventer (BOP), etc.) configured to seal wellbore 4 from the surrounding environment at the surface 5.

Tool string 20 of drilling system 10 has a central or longitudinal axis 25 and includes a coiled tubing 22 which may be suspended within wellbore 4 and which is extendable from surface assembly 11. For example, coiled tubing 22 may be extendable from a tubing reel of surface assembly 11 using a coiled tubing injector of surface assembly 11. Coiled tubing 22 comprises a long, flexible metal pipe including a central bore or passage 24 through which fluids and/or other materials may be circulated therethrough, such as from a surface pump of surface assembly 11. Additionally, in some embodiments, signals may be communicated downhole from the surface assembly 11 via the coiled tubing 22.

Along with coil tubing 22, tool string 20 includes a BHA 50 connected to a terminal end of coiled tubing 22 such that BHA 50 is suspended in the wellbore 4 from coiled tubing 22. In this exemplary embodiment, BHA 50 generally includes an agitator 100 located at an upper end of BHA 50, an orientation sub 52, a telemetry sub 54, a downhole mud motor 56, and a drill bit 60 which is positioned at a terminal end of the BHA 50. Agitator 100 may also be referred to herein as a flow or pressure pulse system 100 and, as will be discussed further herein, is configured to reduce friction between the tool string 20 and a wall 8 of the wellbore 4 by generating a plurality of pressure pulses.

The orientation sub 52 of BHA 50 may include one or more actuators or other mechanisms for controlling the orientation of BHA 50 within wellbore 4 based on telemetry signals provided to a control system of orientation sub 52 by the telemetry sub 54. Telemetry sub 54 may include one or more sensors including measurement while drilling (MWD) sensors, such as inclination and azimuth sensors, that assist in guiding the trajectory of BHA 50 as the drill bit 60 of BHA 50 drills wellbore 4. BHA 50 may include components other than, and/or in addition to, those shown in FIG. 1. Additionally, in other embodiments, BHA 50 may be utilized in a drilling system comprising a drill string that includes a plurality of drill pipes connected end-to-end rather than coiled tubing 22.

Downhole mud motor 56 of BHA 50 powers drill bit 60, permitting drill bit 60 to drill into the formation 6 and thereby form wellbore 4. Particularly, downhole mud motor 56 is configured to convert fluid pressure of a drilling fluid pumped downward through the central passage 24 of coiled tubing 22 into rotational torque for driving the rotation of drill bit 60. With force or weight applied to the drill bit 60, also referred to as weight-on-bit ("WOB"), the rotating drill bit 60 engages the earthen formation 6 and proceeds to form wellbore 4 along a predetermined path toward a target zone. In this exemplary embodiment, drilling fluid pumped down coiled tubing 22 and through downhole mud motor 56 may pass out of the face of drill bit 90 and back up an annulus 12 formed between tool string 20 and the wall 8 of borehole 4. The drilling fluid flowing through drill bit 60 may cool drill bit 50 and flush cuttings away from the face of bit 60, whereby the cuttings may be circulated through the annulus 12 to the surface 5.

Referring now to FIGS. 2-6, an embodiment of the agitator 100 of FIG. 1 is shown. In this exemplary embodiment, agitator 100 generally includes a first or top sub 102 positioned at a first or upper end of agitator 100, a second or bottom sub 120 positioned at a second or lower end of agitator 100, a housing or stator 140, a rotor 170 rotatably disposed in the stator 140, and a valve assembly 200. Top sub 102 of agitator includes a first or upper end 104, a second or lower end 106 opposite upper end 104, a central bore or passage 108 extending between ends 104, 106 and defined by a generally cylindrical inner surface 110, and a generally cylindrical outer surface 112 extending between ends 104, 106. In this exemplary embodiment, the inner surface 110 of top sub 102 includes an internal threaded connector 114 positioned at upper end 104 and which forms a box end of top sub 102. The internal threaded connector 114 of top sub 102 may connected to a lower end of the coiled tubing 22 to couple agitator 100 with coiled tubing 22. Additionally, the outer surface 112 of top sub 102 includes an external threaded connector 116 positioned at lower end 106 and which forms a pin end of top sub 102. Further, an annular seal assembly 118 is positioned on outer surface 112 of top sub 102 proximal the lower end 106 of sub 102.

In this exemplary embodiment, top sub 102 includes a centrally positioned cylindrical plug 117 disposed at the lower end 106 thereof. A plurality of circumferentially spaced ports 119 are formed in the plug 117 of top sub 102 to allow for fluid flow through top sub 102 and into stator 140. In other embodiments, top sub 102 may not include either plug 117 or circumferentially spaced ports 119.

Bottom sub 120 of agitator includes a first or upper end 122, a second or lower end 124 opposite upper end 122, a central bore or passage 126 extending between ends 122, 124 and defined by a generally cylindrical inner surface 128, and a generally cylindrical outer surface 130 extending between ends 122, 124. In this exemplary embodiment, the outer surface 130 of bottom sub 120 includes a first internal threaded connector 132 positioned at upper end 122 and which forms a first or upper pin end of bottom sub 120. Additionally, the inner surface 128 of bottom sub 120 includes a second internal threaded connector 134 positioned at lower end 124 and which forms a second or lower pin end of bottom sub 120. Further, an annular seal assembly 136 is positioned on outer surface 130 of bottom sub 120 proximal the upper end 122 of sub 120.

Figure 3:
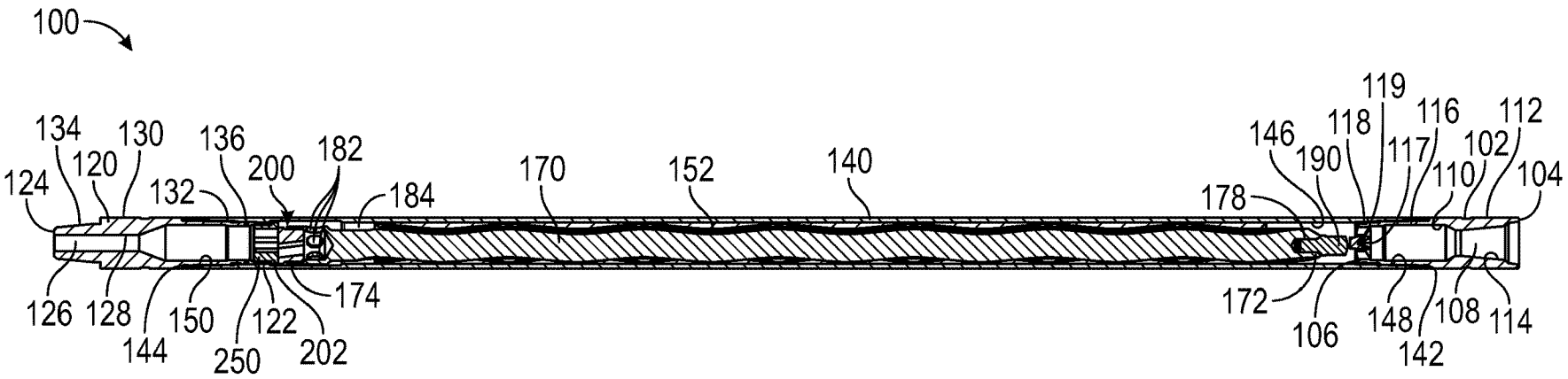
FIG. 3 is a side cross-sectional view of the agitator of FIG. 2.
Figure 4:
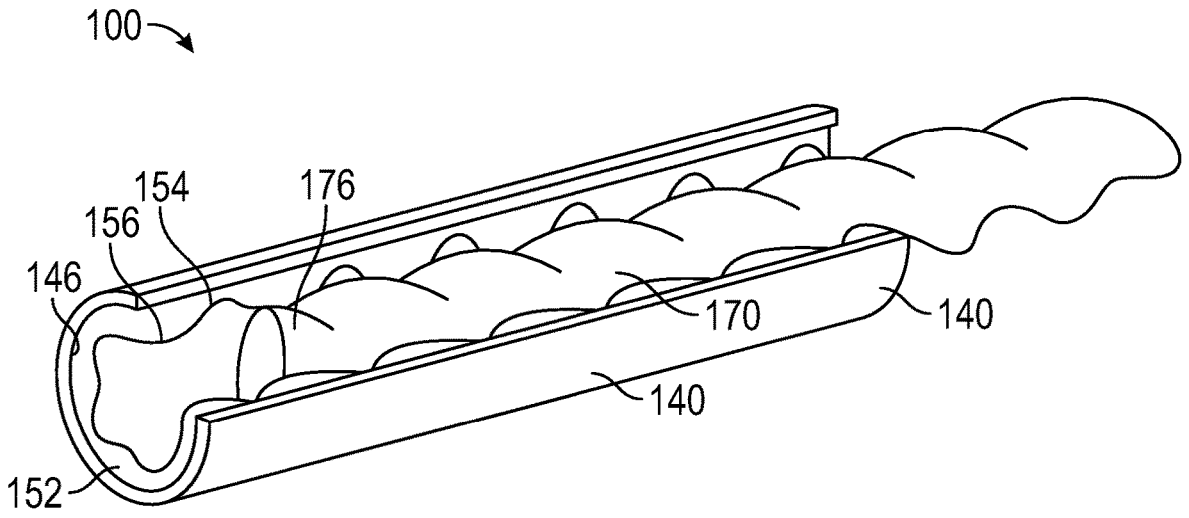
FIG. 4 is a perspective, partial cross-sectional view of the agitator of FIG. 2.
Figure 5:
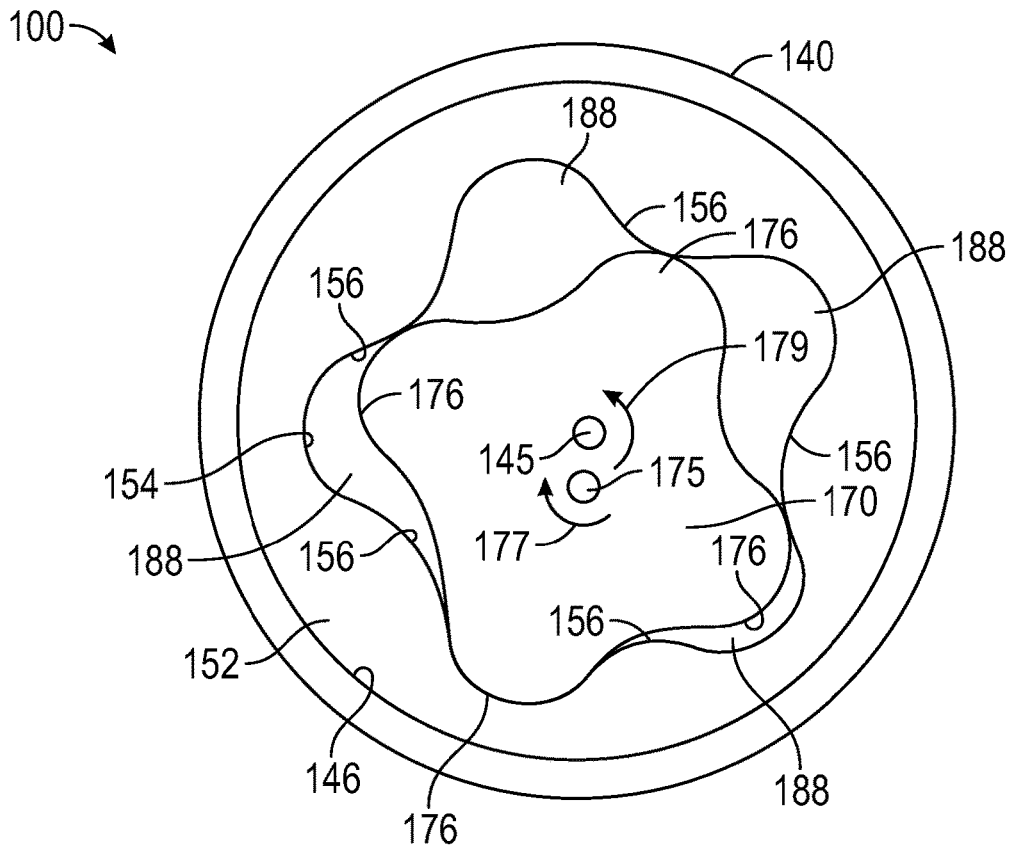
FIG. 5 is an end cross-sectional view of the agitator of FIG. 2.

As shown particularly in FIGS. 3-5, stator 140 includes a central or longitudinal axis 145, a first or upper end 142, a second or lower end 144, and a central passage defined by a generally cylindrical inner surface 146 extending between ends 142, 144. The inner surface 146 of stator 140 includes a first internal threaded connector 148 positioned at upper end 142 and which forms a first or upper box end of stator 140. Threaded connector 148 is configured to threadably couple with the threaded connector 116 of top sub 102 to couple top sub 102 with stator 140. Additionally, the seal assembly 118 of top sub 102 is configured to sealingly engage the inner surface 146 of stator 140 in response to the coupling of stator 140 with top sub 102.

The inner surface 146 of stator 140 additionally includes a second internal threaded connector 150 positioned at lower end 144 and which forms a second or lower box end of stator 140. Threaded connector 150 is configured to threadably couple with the threaded connector 132 of bottom sub 120 to couple bottom sub 120 with stator 140. Additionally, the seal assembly 136 of bottom sub 120 is configured to sealingly engage the inner surface 146 of stator 140 in response to the coupling of stator 140 with bottom sub 120. In this exemplary embodiment, a helical-shaped elastomeric liner or insert 152 is formed on the inner surface 146 of stator 140. A helical-shaped inner surface 154 of elastomeric insert 152 defines a plurality of stator lobs 156 (shown in FIGS. 4, 5). While in this exemplary embodiment stator 140 includes elastomeric insert 152, in other embodiments, stator 140 may not include an insert and instead may comprise a single monolithically formed body.

In this exemplary embodiment, rotor 170 includes a longitudinal or central axis 175, a first or upper end 172, a second or lower end 174 opposite upper end 172, and a helical-shaped outer surface 176 extending between ends 172, 174 and which defines a plurality of rotor lobes 176 which intermesh with the stator lobes 156 of stator 140. Rotor 170 additionally includes a cylindrical first or upper receptacle 178 which extends into the upper end 172 of rotor 170, and a cylindrical second or lower receptacle 180 which extends into the lower end 174 of rotor 170. In this exemplary embodiment, the upper receptacle 178 of rotor 170 receives a cylindrical rotor trap 190 which projects from the upper receptacle 178 and is coupled to the rotor 170. Rotor trap 190 may interact with the plug 117 of top sub 102 to prevent rotor 170 from being ejected from stator 140 during operation. In some embodiments, rotor trap 190 may comprise an axial passage extending entirely therethrough and which may receive a flow nozzle for controlling fluid flow through the axial passage. In other embodiments, agitator 100 may not include rotor trap 190. Additionally, in this exemplary embodiment, a plurality of circumferentially spaced radial ports 182 for formed in rotor 170 proximal the lower end 174 thereof, whereby radial ports 182 provide fluid communication between an annulus 184 formed between the lower end 174 of rotor 170 and the inner surface 146 of stator 140 and the lower receptacle 180 of rotor 170.

As best shown in FIG. 5, in this exemplary embodiment, rotor 170 has one fewer lobe 176 than the stator 140. In this configuration, when rotor 140 and stator 170 are assembled, a series of cavities 188 are formed between the outer surface 176 of rotor 170 and the inner surface 154 of the elastomeric insert 152 of stator 140. Each cavity 188 is sealed from adjacent cavities 188 by seals formed along the contact lines between stator 140 and rotor 170. Additionally, the central axis 175 of rotor 170 is radially offset from the central axis 145 of stator 140 by a fixed value known as the "eccentricity" of the rotor-stator assembly. Consequently, rotor 170 may be described as rotating eccentrically within stator 140.

In this exemplary embodiment, the assembly of stator 140 and rotor 170 forms a progressive cavity device, and particularly, a progressive cavity motor configured to transfer fluid pressure applied to the rotor-stator assembly into rotational torque applied to rotor 170. Specifically, during operation of agitator 100, drilling fluid is pumped under pressure into one end of the agitator 100 where it fills a first set of open cavities 188. A pressure differential across the adjacent cavities 188 forces rotor 170 to rotate relative to the stator 140. As rotor 170 rotates inside stator 140, adjacent cavities 188 are opened and filled with drilling fluid.

As this rotation and filling process repeats in a continuous manner, the drilling fluid flows progressively down the length of agitator 100 and continues to drive the rotation of rotor 170. Rotor 170 rotates about the central axis 175 of rotor 170 in a first rotational direction (indicated by arrow 177 in FIG. 5). Additionally, rotor 170 rotates about the central axis 145 of stator 140 in a second rotational direction (indicated by arrow 179 in FIG. 5) which is the opposite of the first rotational direction of arrow 177. While in this exemplary embodiment, the assembly of stator 140 and rotor 170 operate as a progressive cavity motor, in other embodiments, the assembly of stator 140 and rotor 170 may operate as other progressive cavity devices, such as a progressive cavity pump.

Valve assembly 200 is positioned downstream from rotor 170 of agitator 100. Although in this embodiment valve assembly 200 comprises a component of agitator 100, in other embodiments, valve assembly 200 may comprise a component of other downhole tools. Valve assembly 200 is generally configured to continuously and periodically induce pressure pulses in the drilling fluid flowing through agitator 100 as rotor 170 rotates within stator 140. The energy conveyed by the pressure pulses induced by valve assembly 200 is transferred to the coiled tubing 22 coupled to top sub 102, thereby periodically stretching the coiled tubing 22. The periodic stretching of coiled tubing 22 induced by the pressure pulses induced by agitator 100 may induce oscillating axial motion (motion in the direction of central axis 25) in the coiled tubing 22 (as well as in components of BHA 50) which helps prevent coiled tubing 22 from sticking or locking against the wall 8 of wellbore 4, thereby reducing friction between the coiled tubing 22 and the wall 8 of the wellbore 4. Reducing friction between coiled tubing 22 and the wall 8 of wellbore 4 may increase the speed at which tubing string 20 may be conveyed through the wellbore 4 as well as increase the maximum distance or reach through which the tubing string 20 may extend through the wellbore 4.

Referring now to FIGS. 6-14, valve assembly 200 generally includes a first or upper valve plate 202 (shown in FIGS. 6-10) and a second or lower valve plate 250 (shown in FIGS. 6, 11-14). As will be described further herein, relative rotation between upper valve plate 202 and lower valve plate 250 induces the periodic pressure pulses induced by agitator 100 and described above. Upper valve plate 202 is coupled to rotor 170 in this exemplary embodiment and thus may also be referred to herein as rotor valve plate 202. In this exemplary embodiment, upper valve plate 202 has a central or longitudinal axis 205 and comprises a first or upper end 204, a second or lower end 206 opposite upper end 204, a half-moon shaped flow passage 208 extending between ends 204, 206, and a generally cylindrical outer surface 210 extending between ends 204, 206.

In this exemplary embodiment, flow passage 208 extends at an angle relative to central axis 205 and is defined by an inner surface 212 including a generally planar section 214 (which may include a pair of substantially planar surfaces joined at an obtuse angle) joined to a curved section 216 positioned opposite the planar section 214. In other embodiments, the geometry of flow passage 208 and inner surface 212 may vary. Additionally, upper valve plate 202 includes a planar contact face 215 that defines the lower end 206 of upper valve plate 202. In this exemplary embodiment, upper valve plate 202 is received in the lower receptacle 180 of rotor 170. Upper valve plate 202 may be coupled to rotor 170 whereby relative rotational and axial movement between rotor 170 and upper valve plate 202 is restricted. In this manner, upper valve plate 202 may rotate in concert with rotor 170, the central axis 205 of upper valve plate 202 being coaxial with the central axis 175 of rotor 170.

Lower valve plate 250 of valve assembly 200 is coupled to stator 140 in this exemplary embodiment and thus may also be referred to herein as stator valve plate 250. In other embodiments, lower valve plate 250 may be coupled to rotor 170 while upper valve plate 102 is coupled to stator 140. In this exemplary embodiment, lower valve plate 250 has a central or longitudinal axis 255 and comprises a first or upper end 252, a second or lower end 254 opposite upper end 252, a half-moon shaped first flow passage 256 extending between ends 252, 254, a second flow passage 258 that is separate and spaced from first flow passage 256 and which extends between ends 252, 254, and a generally cylindrical outer surface 260 extending between ends 252, 254.

In this exemplary embodiment, first flow passage 256 extends parallel with central axis 255 and is defined by an inner surface 262 including a generally planar section 264 (which may include a pair of substantially planar surfaces joined at an obtuse angle) joined to a curved section 266 positioned opposite the planar section 264. The cross-section of first flow passage 256 of lower valve plate 250 may be similar in shape as the flow passage 208 of upper valve plate 202. In other embodiments, the geometry of first flow passage 256 and inner surface 262 may vary. In this exemplary embodiment, second flow passage 258 is defined by a generally cylindrical inner surface 268. The inner surface 268 of second flow passage 258 may include a radially expanding lip 270 at the second end 254 of lower valve plate 250. In other embodiments, the geometry of second flow passage 258 may vary.

The second flow passage 258 is circumferentially spaced (approximately 180 degrees in this exemplary embodiment) about central axis 255 from the first flow passage 256. Additionally, in this embodiment, the second flow passage 258 is radially offset a greater distance from central axis 255 than first flow passage 256. However, in other embodiments, the arrangement of flow passages 256, 258 relative to each other and to central axis 255 may vary. The first flow passage 256 has a minimum cross-sectional or flow area 257 while the second flow passage 258 comprises a minimum cross-sectional or flow area 259 which is less than the minimum flow area 257. First flow passage 256 may thus also be referred to herein as maximum flow passage 256 while second flow passage 258 may also be referred to herein as minimum flow passage 258. Additionally, the minimum flow area 259 of second flow passage 258 is less than a minimum cross-sectional or flow area 218 (shown in FIGS. 8, 9) of the flow passage 208 of upper valve plate 202. Thus, the minimum flow area 259 of second flow passages 258 may define a minimum flow area of each of flow passages 208, 256, and 258 of the valve plates 202, 250, respectively.

The lower valve plate 250 additionally includes a planar contact face 272 that defines the upper end 252 of lower valve plate 250. Lower valve plate 250 is coupled to stator 140 such that relative rotation between lower valve plate 250 and stator 140 is restricted. Particularly, in this embodiment, lower valve plate 250 is coupled to the upper end 122 of bottom sub 120 such that lower valve plate 250 extends into the central passage 126 of bottom sub 120. In other embodiments, lower valve plate 250 may couple directly to stator 140 instead of through bottom sub 120. Additionally, the outer surface 260 of lower valve plate 250 may seal against the inner surface 128 of bottom sub 120 such that fluid flow may be restricted between the annular interface formed between lower valve plate 250 and bottom sub 120.

Figure 6:
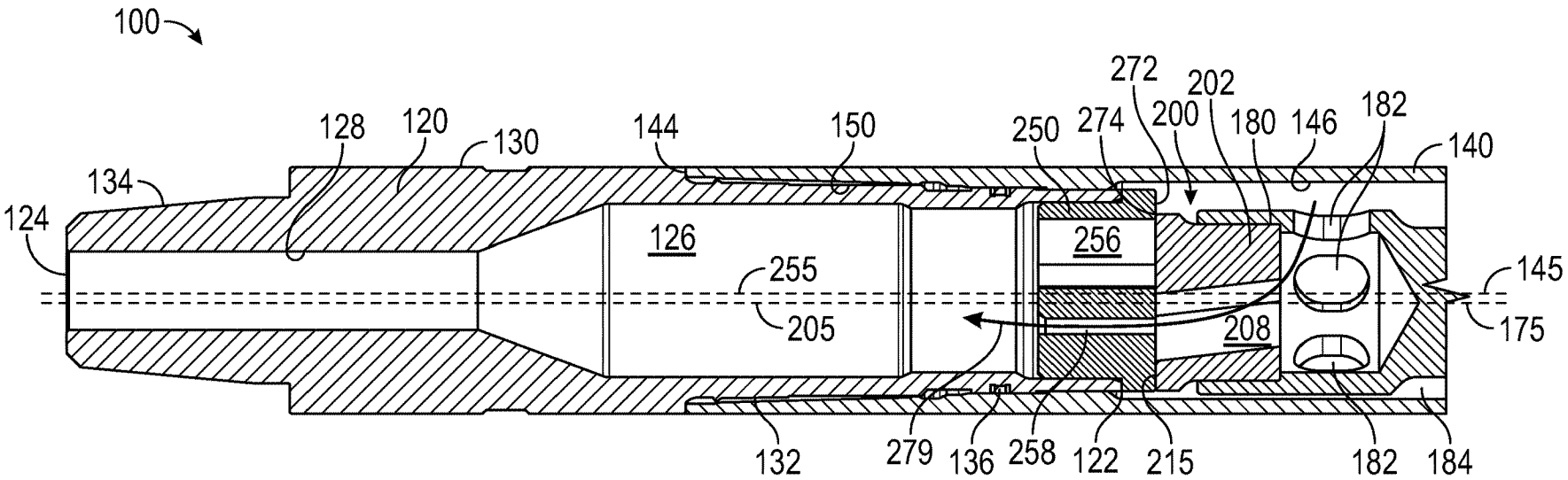
FIG. 6 is an enlarged side cross-sectional view of the agitator of FIG. 2.
Figure 7:
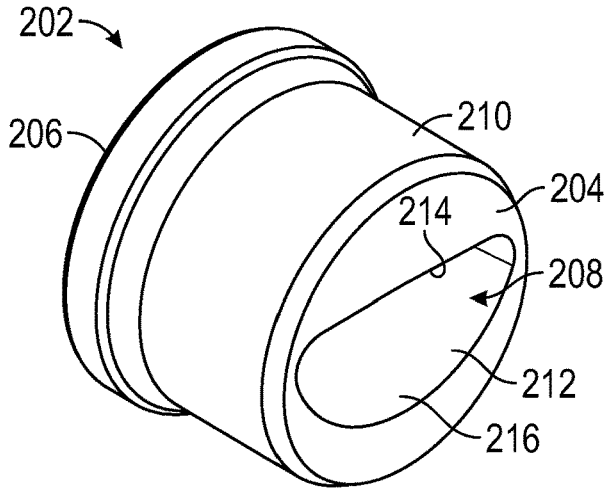
FIG. 7 is a perspective view of a first valve plate of the agitator of FIG. 2 according to some embodiments.
Figure 8:
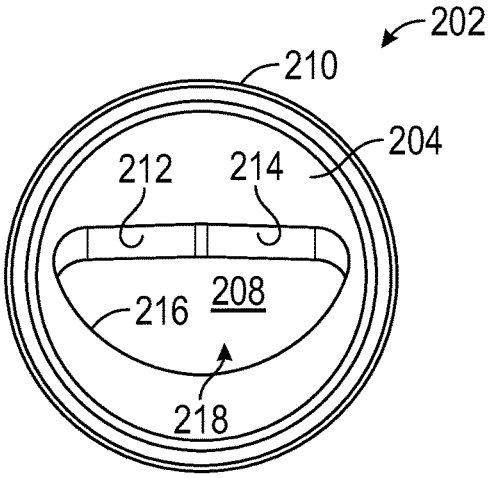
FIG. 8 is a front view of the first valve plate of FIG. 7.
Figure 9:
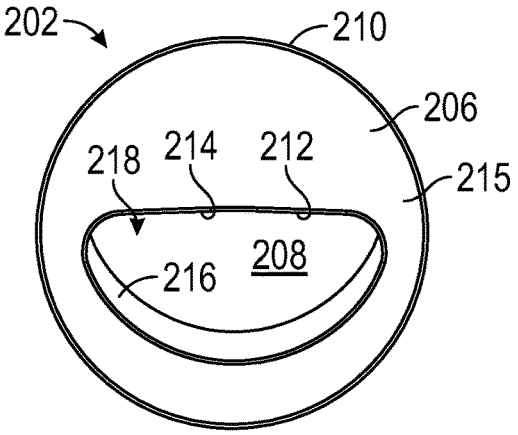
FIG. 9 is a rear view of the first valve plate of FIG. 7.
Figure 10:
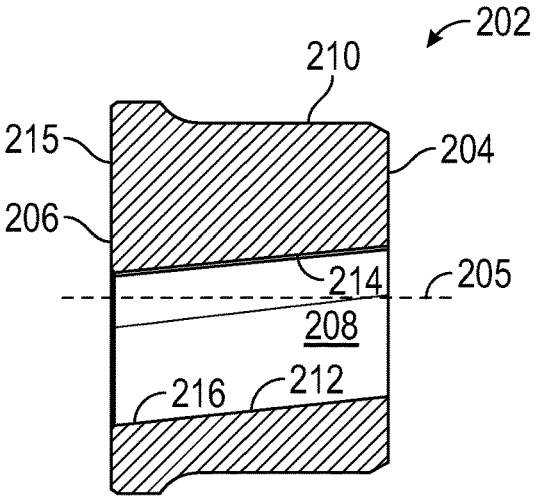
FIG. 10 is a side cross-sectional view of the first valve plate of FIG. 7.
Figure 11:
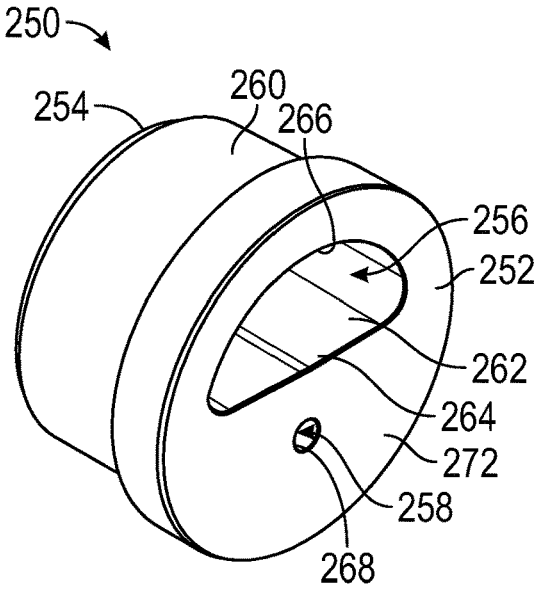
FIG. 11 is a perspective view of a second valve plate of the agitator of FIG. 2 according to some embodiments.
Figure 12:
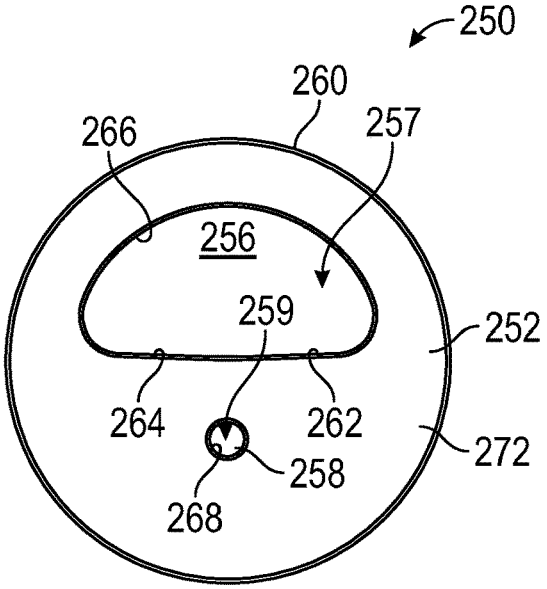
FIG. 12 is a front view of the second valve plate of FIG. 11.
Figure 13:
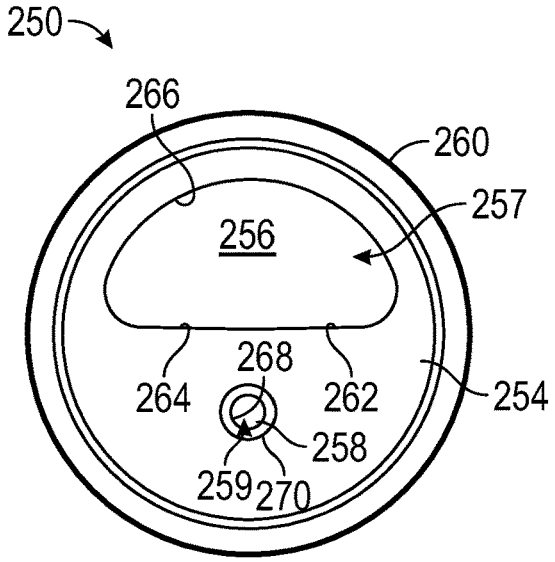
FIG. 13 is a rear view of the second valve plate of FIG. 11.
Figure 14:
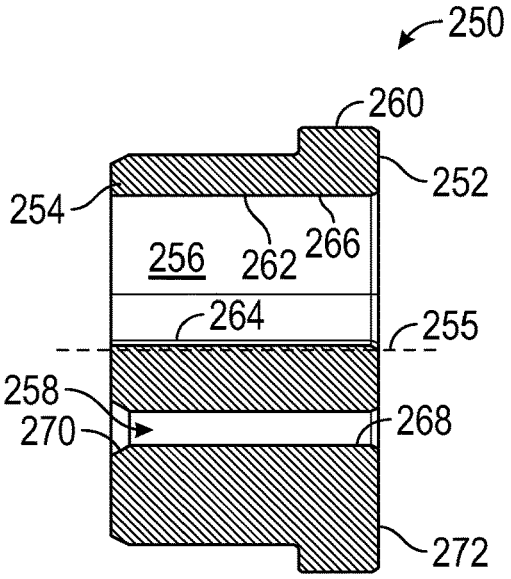
FIG. 14 is a side cross-sectional view of the second valve plate of FIG. 11.

Referring to FIGS. 6, 15-20, when agitator 100 is assembled as shown in FIG. 6, the contact face 215 of upper valve plate 202 slidably contacts the contact face 272 of lower valve plate 250. A metal-to-metal sealing interface 274 may be formed between the contacting portions of contact faces 215, 272, restricting fluid flow across the sealing interface 274. Additionally, as shown particularly in FIGS. 17-20, with upper valve plate 202 coupled to rotor 170 and central axis 205 of upper valve plate 202 being coaxial with central axis 175 of rotor 170, upper valve plate 202 rotates about central axis 205 in the first rotational direction 177 in response to the rotation of rotor 170 within stator 140. Additionally, with lower valve plate 250 coupled to stator 140 and central axis 255 of lower valve plate 250 being coaxial with central axis 145 of stator 140, upper valve plate 202 also rotates about the central axis 255 but in the second rotational direction 179 in response to the rotation of rotor 170 within stator 140. In this embodiment, central axis 205 of upper valve plate 202 is radially offset from the central axis 255 of lower valve plate 250; however, in other embodiments, central axis 205 of upper valve plate 202 may be coaxial with central axis 255 of lower valve plate 250. For example, upper valve plate 202 may be coupled to rotor 170 via a flexible shaft which allows valve plates 202, 250 to rotate about the same axis. Aligning the central axes of valve plates 202, 250 may eliminate the need to time valve plates 202, 250 and to maximize the maximum flow area providable through valve 200 which may be dependent upon the degree of eccentricity between valve plates 202, 250.

Drilling fluid may be communicated from annulus 184, through valve assembly 200, and into the central passage 126 of bottom sub 120. Particularly, drilling fluid may flow into lower receptacle 180 via radial ports 182 and into the flow passage 208 of upper valve plate 202. The drilling fluid in flow passage 208 may flow through first flow passage 256, second flow passage 258, or both first and second flow passages 256, 258 depending on the angular orientation between valve plates 202, 250 whereby the drilling fluid may enter the central passage 126 of bottom sub 120.

Figure 15:
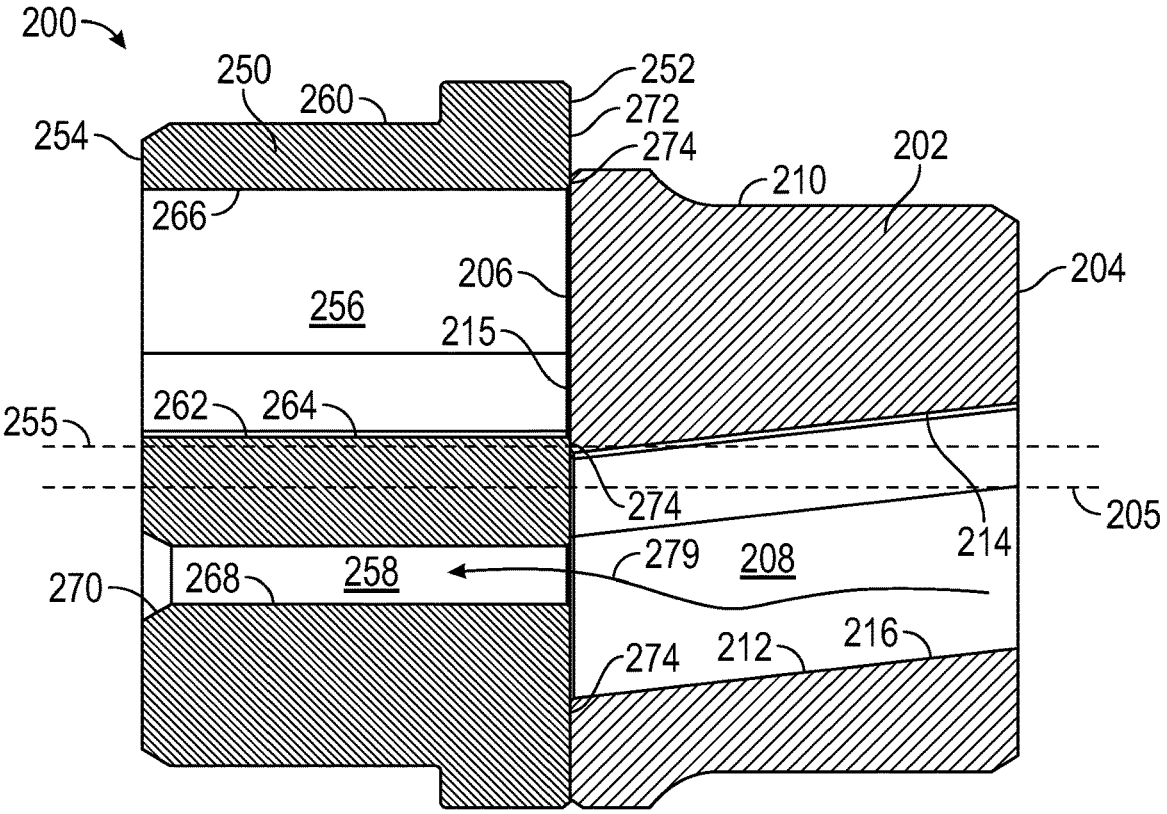
FIG. 15 is a side cross-sectional view of the first valve plate of FIG. 7 and the second valve plate of FIG. 11 in a first angular orientation.
Figure 16:
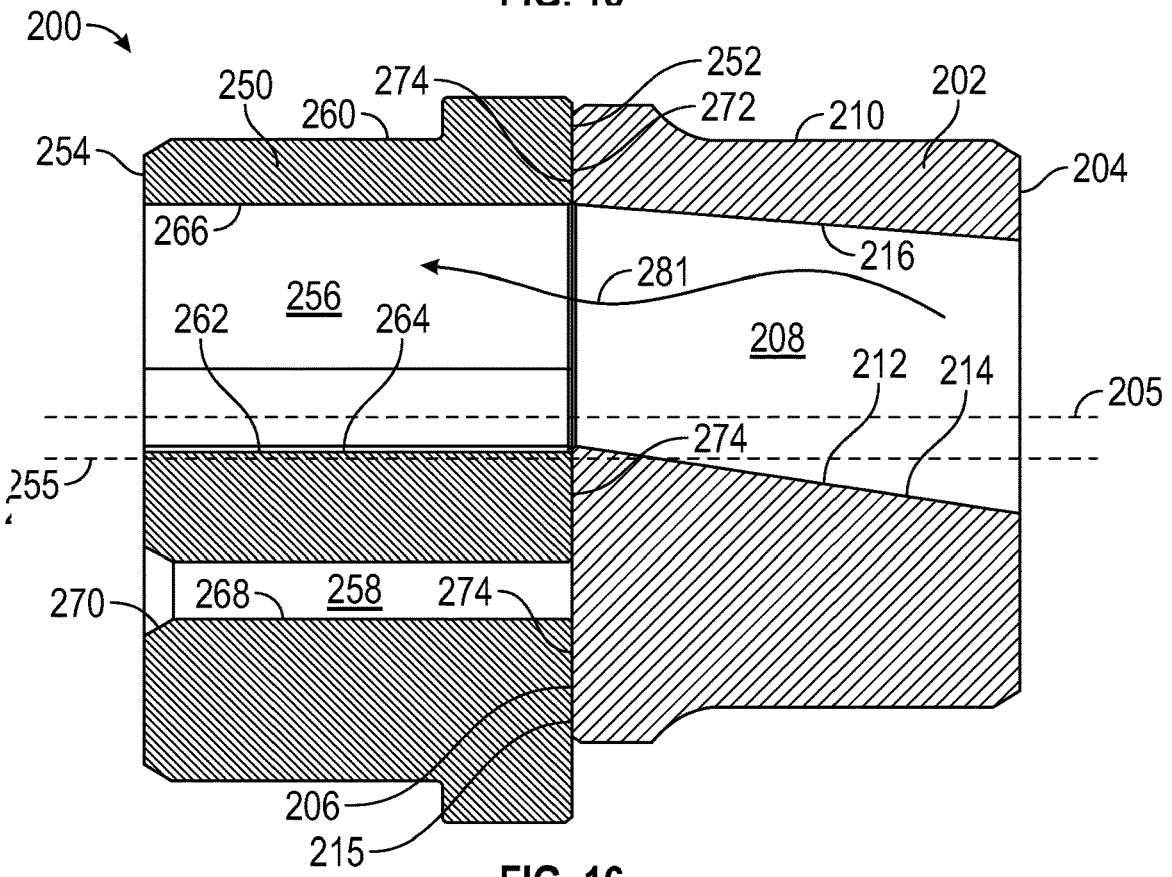
FIG. 16 is a side cross-sectional view of the first valve plate of FIG. 7 and the second valve plate of FIG. 11 in a second angular orientation.
Figure 17:
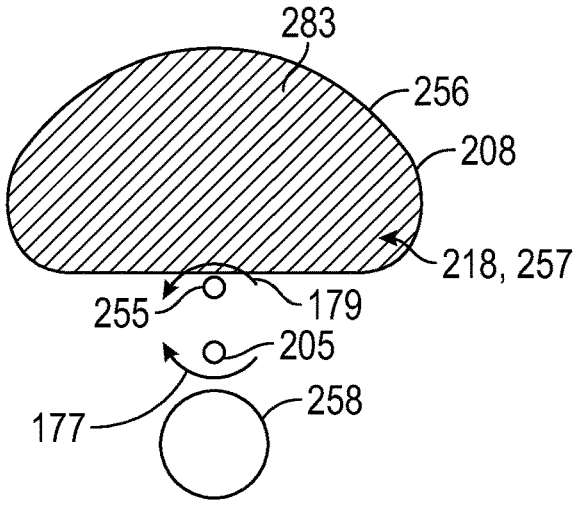
FIG. 17 is a schematic end view of the first valve plate of FIG. 7 and the second valve plate of FIG. 11 in the second angular orientation.
Figure 19:
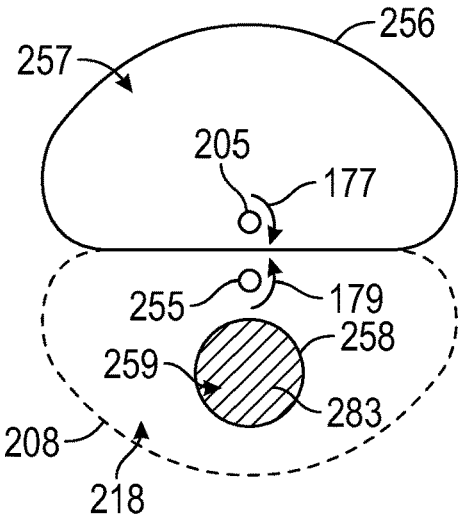
FIG. 19 is a schematic end view of the first valve plate of FIG. 7 and the second valve plate of FIG. 11 in the first angular orientation.

Particularly, as upper valve plate 202 rotates in concert with rotor 170, valve 200 is continuously and periodically (at a given rotational rate of rotor 170) between a minimum flow configuration shown in FIGS. 6, 15, and 19 and a maximum flow configuration shown in FIGS. 16, 17. In the minimum flow configuration of valve 200 the entirety of flow passage 208 is spaced from first flow passage 256 of lower valve plate 250 whereby sealing interface 274 restricts fluid flow directly between flow passages 208, 256. Thus, in the minimum flow configuration of valve 200, drilling fluid flows along a first flowpath 279 (shown in FIGS. 6, 15) extending from flow passage 208 of upper valve plate 202, through the second flow passage 258 of lower valve plate 250, and into the central passage 126 of bottom sub 120.

The first flowpath 279 may have a minimum cross-sectional or flow area that corresponds to a minimum flow area providable through valve assembly 200. Additionally, the minimum flow area of the first flowpath 279 may be defined by the minimum flow area 259 of the second flow passage 258 of lower valve plate 250. Sealing contact between contact faces 215, 272 along sealing interface 274 may restrict fluid communication between flow channel 208 and first flow channel 256 when valve assembly is in the minimum flow configuration.

In the maximum flow configuration of valve 200 the entirety of the flow passage 208 of upper valve plate 202 is spaced from second flow passage 258 of lower valve plate 250 whereby sealing interface 274 restricts fluid flow directly between flow passages 208, 258. Thus, in the maximum flow configuration of valve 200, drilling fluid flows along a second flowpath 281 (shown in FIG. 16) that is distinct from the first flowpath 279 and which extends from flow passage 208 of upper valve plate 202, through the first flow passage 256 of lower valve plate 250, and into the central passage 126 of bottom sub 120. The second flowpath 279 may have a minimum cross-sectional or flow area that corresponds to a maximum flow area providable through valve assembly 200. Sealing contact between contact faces 215, 272 along sealing interface 274 may restrict fluid communication between flow channel 208 and second flow channel 258 when valve assembly is in the minimum flow configuration.

Valve assembly 200 defines a minimum cross-sectional or flow area 283 (shown in FIGS. 17-20 through which drilling fluid may be conveyed through valve assembly 200. The minimum flow area 283 through valve assembly 200 varies depending on the relative angular orientation between valve plates 202, 250. Particularly, the minimum flow area 283 through valve assembly 200 may correspond to the amount or degree of overlap between the flow passage 208 of upper valve plate 250 and first flow passage 256 and/or second flow passage 258 of lower valve plate 250. For example, in the maximum flow configuration of valve assembly 200, the flow passage 208 of upper valve plate 202 nearly or entirely overlaps with first flow passage 256 (and is entirely spaced from second flow passage 258) of lower valve plate 250 whereby the minim flow area 283 through valve assembly 200 when in the maximum flow configuration corresponds to the lesser of the minimum flow areas 218, 257 of flow passages 208, 256, respectively. The maximum flow configuration of valve assembly 200 comprises the largest minimum flow area 283 through valve assembly.

Conversely, in the minimum flow configuration of valve assembly 200, the flow passage 208 of upper valve plate 202 nearly or entirely overlaps with the second flow passage 258 of lower valve plate 250 (and is entirely spaced from first flow passage 256) whereby the minim flow area 283 through valve assembly 200 when in the minimum flow configuration corresponds to the minimum flow area 259 of second flow passage 258 given that minimum flow area 259 is less than the minimum flow area 218 of flow passage 208. Thus, the minimum flow area 283 through valve assembly 200 when in the minimum flow configuration is defined by the minimum flow area 259 of the second flow passage 258 of lower valve plate 250. The minimum flow configuration of valve assembly 200 comprises the smallest minimum flow area 283 through valve assembly.

Figure 18:
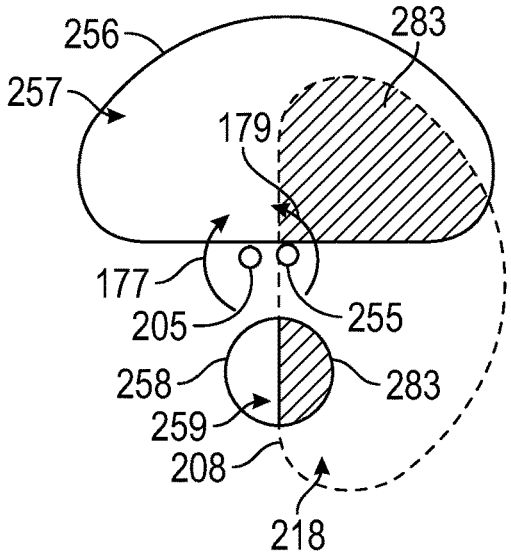
FIG. 18 is a schematic end view of the first valve plate of FIG. 7 and the second valve plate of FIG. 11 in a third angular orientation.
Figure 20:
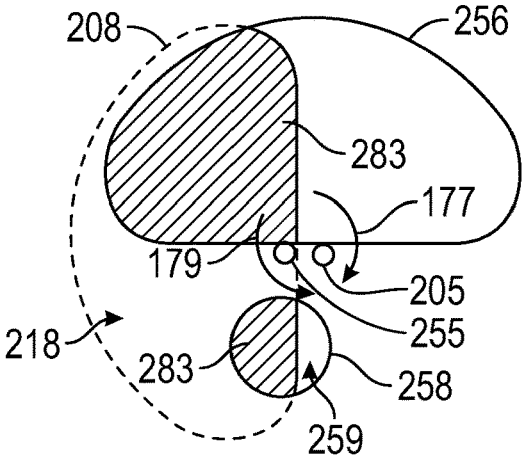
FIG. 20 is a schematic end view of the first valve plate of FIG. 7 and the second valve plate of FIG. 11 in a fourth angular orientation.

The minimum flow area 283 through valve assembly 200 may be contiguous or non-contiguous depending on the relative angular orientation between valve plates 202, 250. For example, FIGS. 18, 20 illustrate configurations of valve assembly 200 in which the flow passage 208 of upper valve plate 202 partially overlaps both the first flow passage 256 and the second flow passage 258 of lower valve plate 250. Thus, in the configurations of valve assembly 200 shown in FIGS. 18, 20, the minimum flow area 283 of the valve assembly 200 corresponds to the sum of the area over which flow passage 208 overlaps first flow passage 256 and the area over which flow passage 208 overlaps second flow passage 258. Additionally, the configurations of valve assembly 200 shown in FIGS. 18, 20 each comprise a minimum flow area 283 which is both less than the minimum flow area 283 through valve assembly 200 when in the maximum flow configuration and greater than the minimum flow area 283 through valve assembly 200 when in the minimum flow configuration.

As described above, as upper valve plate 202 rotates about both axes 205, 255, valve assembly 200 continuously and periodically (at given rotational rate of rotor 170) transitions between the minimum flow configuration, which corresponds to a minimum or smallest minimum flow area 283 providable by valve assembly 200, and the maximum flow configuration, which corresponds to a maximum or greatest minimum flow area 283 providable by valve assembly 200. An obstruction to the flow of drilling fluid through agitator 100 may increase as the minimum flow area 283 decreases, increasing an amount of backpressure applied to the drilling fluid entering valve assembly 200 from annulus 184. The minimum flow area 283 may decrease substantially as valve assembly 200 enters the minimum flow configuration, rapidly increasing the backpressure applied to annulus 184 such that a pressure pulse is induced in the drilling fluid in annulus 184. The pressure pulse induced by valve assembly 200 as valve assembly 200 enters the minimum flow configuration may be communicated to coiled tubing 22, thereby inducing oscillating axial motion in coiled tubing 22.

As shown particularly, in FIG. 19, the second flow passage 258 of lower valve plate 250 is encompassed entirely within the flow passage 208 of upper plate 202 when valve assembly 200 is in the minimum flow configuration. Thus, a minor change to the diameter of the connector 132 of bottom sub 130, which may radially shift the position of second flow passage 258 of lower valve plate 250 relative to flow passage 208 of upper valve plate 202, will not result in a change to the flow area 283 of FIG. 19 given the amount of space separating an outer edge of second flow passage 258 and the outer edge of flow passage 208. In other words, the space between the outer edge of second flow passage 258 and the outer edge of flow passage 208 provides a margin of error making minor differences in the sizes of the components of agitator 100 (due to the respective manufacturing tolerances of these components) irrelevant to the magnitude of the minimum flow area 283 through valve assembly 200 when assembly 100 is in the minimum flow configuration. Along with providing an agitator 100 with a more predictable pressure pulse, this margin for error may allow for components having a less precise manufacturing tolerance to be used in the assembly of agitator 100.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A pressure pulse system disposable in a wellbore, comprising:

a stator comprising a plurality of helical stator lobes;

a rotor rotatably positioned in the stator and comprising a plurality of helical rotor lobes; and a valve assembly coupled to the stator and to the rotor and configured to induce a pressure pulse in response to rotation of the rotor within the stator, wherein the valve assembly comprises:

a first valve plate coupled to one of the stator and the rotor and comprising a flow passage; and a second valve plate coupled to the other of the stator or the rotor to which the first valve plate is not coupled and comprising a first flow passage and a second flow passage that is spaced from the first flow passage of the second valve plate, wherein a central axis of the first valve plate is offset from a central axis of the second valve plate whereby the second valve plate is configured to rotate eccentrically relative to the first valve plate;

wherein the valve assembly comprises a first configuration that provides a first flowpath between the flow passage of the first valve plate and the second flow passage of the second valve plate, and wherein the second flow passage of the second valve plate is encompassed entirely within the flow passage of the first valve plate in an end view when the valve assembly is in the first configuration;

wherein the valve assembly comprises a second configuration that provides a second flowpath between the flow passage of the first valve plate and the first flow passage of the second valve plate.

2. The pressure pulse system of claim 1, wherein the second flow passage of the second valve plate is circumferentially spaced about the central axis of the second valve plate from the first flow passage of the second valve plate.

3. The pressure pulse system of claim 2, wherein:

the first valve plate is coupled to the rotor and the central axis of the first valve plate is coaxial with a central axis of the rotor; and the second valve plate is coupled to the stator and the central axis of the second valve plate is coaxial with a central axis of the stator.

4. The pressure pulse system of claim 3, wherein the first valve plate rotates about the central axis of the first valve plate in a first rotational direction and about the central axis of the second valve plate in a second rotational direction opposite the first rotational direction.

5. The pressure pulse system of claim 1, wherein a minimum flow area of the second flow passage of the second valve plate is less than both a minimum flow area of the first flow passage of the second valve plate and a minimum flow area of the flow passage of the first valve plate.

6. The pressure pulse system of claim 1, wherein the first flowpath has a minimum flow area that corresponds to a minimum flow area providable through the valve assembly.

7. The pressure pulse system of claim 1, wherein the minimum flow area of the first flowpath corresponds to a minimum flow area providable through the valve assembly, and wherein a minimum flow area of the second flow passage of the second valve plate defines the minimum flow area of the first flowpath.

8. A pressure pulse system disposable in a wellbore, comprising:

a stator comprising a plurality of helical stator lobes;

a rotor rotatably positioned in the stator and comprising a plurality of helical rotor lobes; and a valve assembly coupled to the stator and to the rotor and configured to induce a pressure pulse in response to rotation of the rotor within the stator, wherein the valve assembly comprises:

a first valve plate coupled to one of the stator and the rotor and comprising a flow passage; and a second valve plate coupled to the other of the stator or the rotor to which the first valve plate is not coupled and comprising a flow passage;

wherein the valve assembly comprises a first configuration that provides a first flowpath through the valve assembly between the flow passage of the first valve plate and the flow passage of the second valve plate, the first flowpath having a minimum flow area that corresponds to a minimum flow area providable through the valve assembly, and wherein the flow passage of the second valve plate is encompassed entirely within the flow passage of the first valve plate in an end view when the valve assembly is in the first configuration.

9. The pressure pulse system of claim 8, wherein a minimum flow area of the flow passage of the second valve plate is less than a minimum flow area of the flow passage of the first valve plate.

10. The pressure pulse system of claim 8, wherein the second valve plate comprises a first flow passage and a second flow passage that is spaced from the first flow passage, the second flow passage corresponding to the flow passage that is encompassed entirely within the flow passage of the first valve plate in an end view when the valve assembly is in the first configuration.

11. The pressure pulse system of claim 10, wherein:

the first valve plate is coupled to the rotor and a central axis of the first valve plate is coaxial with a central axis of the rotor; and the second valve plate is coupled to the stator and a central axis of the second valve plate is coaxial with a central axis of the stator, wherein the central axis of the second valve plate is offset from the central axis of the first valve plate.

12. The pressure pulse system of claim 11, wherein the first valve plate rotates about the central axis of the first valve plate in a first rotational direction and about the central axis of the second valve plate in a second rotational direction opposite the first rotational direction.

13. The pressure pulse system of claim 10, wherein the valve assembly comprises a second configuration that provides a second flowpath between the flow passage of the first valve plate and the first flow passage of the second valve plate.

14. The pressure pulse system of claim 13, the second flowpath has a minimum flow area that corresponds to a maximum flow area providable through the valve assembly.

15. The pressure pulse system of claim 8, wherein a minimum flow area of the flow passage of the second valve plate defines the minimum flow area of the first flowpath.

16. A pressure pulse system disposable in a wellbore, comprising:

a stator comprising a plurality of helical stator lobes;

a rotor rotatably positioned in the stator and comprising a plurality of helical rotor lobes; and a valve assembly coupled to the stator and to the rotor and configured to induce a pressure pulse in response to rotation of the rotor within the stator, wherein the valve assembly comprises:

a first valve plate coupled to one of the stator and the rotor and comprising a flow passage; and a second valve plate coupled to the other of the stator or the rotor to which the first valve plate is not coupled and comprising a flow passage;

wherein the valve assembly comprises a first configuration that provides a first flowpath through the valve assembly between the flow passage of the first valve plate and the flow passage of the second valve plate, wherein a minimum flow area of the first flowpath corresponding to a minimum flow area providable through the valve assembly, and wherein a minimum flow area of the flow passage of the second valve plate defines the minimum flow area of the first flowpath;

wherein the flow passage of the second valve plate is encompassed entirely within the flow passage of the first valve plate in an end view when the valve assembly is in the first configuration.

17. The pressure pulse system of claim 16, wherein a minimum flow area of the flow passage of the second valve plate is less than a minimum flow area of the flow passage of the first valve plate.

18. The pressure pulse system of claim 16, wherein the second valve plate comprises a first flow passage and a second flow passage that is spaced form the first flow passage, the second flow passage corresponding to the flow passage that defines the minimum flow area of the first flowpath.

19. The pressure pulse system of claim 18, wherein the valve assembly comprises a second configuration that provides a second flowpath between the flow passage of the first valve plate and the first flow passage of the second valve plate, the second flowpath having a minimum flow area that corresponds to a maximum flow area providable through the valve assembly.

* * * * *